US010746065B2

(12) United States Patent
Eichmueller et al.

(10) Patent No.: US 10,746,065 B2
(45) Date of Patent: Aug. 18, 2020

(54) EXHAUST-GAS SYSTEM

(71) Applicant: Bayerische Motoren Werke Aktiengesellschaft, Munich (DE)

(72) Inventors: Christian Eichmueller, Munich (DE); Rainer Drees, Munich (DE)

(73) Assignee: Bayerische Motoren Werke Aktiegesellschaft, Munich (DE)

( * ) Notice: Subject to any disclaimer, the term of this patent is extended or adjusted under 35 U.S.C. 154(b) by 235 days.

(21) Appl. No.: 15/716,030

(22) Filed: Sep. 26, 2017

(65) Prior Publication Data

US 2018/0016954 A1 Jan. 18, 2018

Related U.S. Application Data

(63) Continuation of application No. PCT/EP2016/062109, filed on May 30, 2016.

(30) Foreign Application Priority Data

Jun. 22, 2015 (DE) ..... 10 2015 211 460

(51) Int. Cl.

| | |
|---|---|
| ***F01N 1/00*** | (2006.01) |
| ***F01N 1/02*** | (2006.01) |
| ***F01N 1/06*** | (2006.01) |
| ***F01N 13/04*** | (2010.01) |
| ***F01N 13/10*** | (2010.01) |
| ***F01N 1/16*** | (2006.01) |

(52) U.S. Cl.

CPC ..... *F01N 1/003* (2013.01); *F01N 1/02* (2013.01); *F01N 1/06* (2013.01); *F01N 1/163* (2013.01); *F01N 1/168* (2013.01); *F01N 13/04* (2013.01); *F01N 13/107* (2013.01); *F01N 2240/36* (2013.01); *F01N 2260/14* (2013.01)

(58) Field of Classification Search

CPC ..... F01N 1/003; F01N 1/168; F01N 1/163; F01N 13/02; F01N 13/04; F01N 13/06; F01N 13/107; F01N 2240/36; F01N 2260/14

USPC ..... 181/266, 237, 228

See application file for complete search history.

(56) References Cited

U.S. PATENT DOCUMENTS 2,297,046 A 9/1942 Bourne
3,114,432 A 12/1963 Ludlow et al.
(Continued)

FOREIGN PATENT DOCUMENTS

CN 1959077 A 5/2007
DE 647 118 C 6/1937
(Continued)

OTHER PUBLICATIONS

International Search Report (PCT/ISA/210) issued in PCT Application No. PCT/EP2016/062109 dated Jul. 22, 2016 with English translation (Eight (8) pages).
(Continued)

*Primary Examiner* — Forrest M Phillips
(74) *Attorney, Agent, or Firm* — Crowell & Moring LLP

(57) ABSTRACT

An exhaust-gas system for a vehicle having an internal combustion engine includes a Helmholtz resonator and two exhaust-gas lines extending toward the resonator. The resonator has two neck openings to a resonator volume. Each neck opening is coupled to one of the exhaust-gas lines, and the resonator is tuned to damp a dominant engine order.

13 Claims, 3 Drawing Sheets

(56) References Cited

U.S. PATENT DOCUMENTS

| | | | | |
|---|---|---|---|---|
| 6,938,729 | B2 * | 9/2005 | Worner | F01N 1/166 181/232 |
| 7,703,574 | B2 * | 4/2010 | Kruger | F01N 13/02 181/253 |
| 7,874,401 | B2 * | 1/2011 | Uhlemann | F01N 1/006 181/250 |
| 8,826,651 | B2 * | 9/2014 | Laube | F01N 1/166 181/211 |
| 2005/0067219 | A1 | 3/2005 | Albertson et al. | |
| 2005/0230182 | A1 | 10/2005 | Nezan et al. | |
| 2007/0045041 | A1 | 3/2007 | Krueger et al. | |
| 2010/0043398 | A1 * | 2/2010 | Abram | F01N 1/16 60/273 |
| 2011/0000201 | A1 * | 1/2011 | Laube | F01N 1/166 60/324 |
| 2012/0097478 | A1 * | 4/2012 | Keck | F01N 1/026 181/228 |
| 2014/0161671 | A1 * | 6/2014 | Cuellar | F01N 13/08 422/115 |
| 2014/0166394 | A1 * | 6/2014 | Winkel | F01N 13/107 181/228 |
| 2016/0024989 | A1 | 1/2016 | Eichmueller et al. | |
| 2016/0053658 | A1 | 2/2016 | Drees et al. | |

FOREIGN PATENT DOCUMENTS

| | | | | |
|---|---|---|---|---|
| DE | 43 30 129 | A1 | 3/1995 | |
| DE | 200 03 666 | U1 | 6/2000 | |
| DE | 100 84 870 | T1 | 4/2003 | |
| DE | 10 2004 046 184 | A1 | 5/2005 | |
| DE | 10 2012 112 433 | A1 | 6/2014 | |
| DE | 10 2013 208 946 | A1 | 11/2014 | |
| DE | 10 2013 210 464 | A1 | 12/2014 | |
| EP | 1 400 666 | A1 | 3/2004 | |
| EP | 2 287 452 | A1 | 2/2011 | |
| FR | 2864199 | A1 * | 6/2005 | F01N 1/003 |
| GB | 995 528 | A | 6/1965 | |
| GB | 2 161 215 | A | 1/1986 | |

OTHER PUBLICATIONS

German-language International Written Opinion issued in PCT Application No. PCT/EP2016/062109 dated Jul. 22, 2016 (Six (6) pages).

German-language Search Report issued in German Application No. 10 2015 211 460.0 dated Feb. 16, 2016 with Partial English-Translation (Twelve (12) pages).

Chinese-language Office Action issued in counterpart Chinese Application No. 201680013210.1 dated Jan. 18, 2019 with English translation (13 pages).

Chinese Office Action issued in Chinese counterpart application No. 201680013210.1 dated Aug. 26, 2019, with English translation (Seventeen (17) pages).

* cited by examiner

EXHAUST-GAS SYSTEM

CROSS REFERENCE TO RELATED APPLICATIONS

This application is a continuation of PCT International Application No. PCT/EP2016/062109, filed May 30, 2016, which claims priority under 35 U.S.C. § 119 from German Patent Application No. 10 2015 211 460.0, filed Jun. 22, 2015, the entire disclosures of which are herein expressly incorporated by reference.

BACKGROUND AND SUMMARY OF THE INVENTION

The present invention relates to an exhaust-gas system for a vehicle having an internal combustion engine, including a Helmholtz resonator and two exhaust-gas lines extending towards the resonator.

Exhaust-gas systems for multi-cylinder, high-performance internal combustion engines are normally provided with two exhaust-gas systems separated from one another. Each originate, for example, from a cylinder bank of a V-type engine or, for example, also from two or three cylinders of a multi-cylinder in-line engine in each case.

The advantage of the configuration with separate exhaust-gas lines over a single exhaust-gas line with a large individual cross section is that it is easier to install, particularly due to the small amount of space available in a vehicle. Nevertheless, it provides sufficiently large cross sections for the exhaust-gas line.

In addition to a shared or also separate exhaust-gas catalytic converter, further components are installed in the exhaust-gas lines to reduce the combustion-related noise emissions from the internal combustion engine, such as, for example, front mufflers, mid-mufflers or also rear mufflers and, finally, the exhaust-gas lines also still each comprise end pipes or else exhaust-gas outlet openings.

It is already known in the art for selectively tuned Helmholtz resonators or $\lambda/4$ mufflers to be provided in the housing of the rear muffler or also connected to the rear muffler by a branch line. These resonators or mufflers are each tuned to a speed range of the internal combustion engine in which the internal combustion engine is inclined towards conspicuous droning frequencies that are inconsistent with the vehicle's comfort specifications. The aim is for these devices, which influence the noise emissions from the internal combustion engine, to selectively lower the opening level at the exhaust-gas outlet or the exhaust-gas outlet openings.

DE 200 03 666 U1 discloses a multi-stage Helmholtz resonator in which the resonator capacity can be increased or reduced via a switchable flap provided in the resonator housing, as a result of which a sound level reduction of two different main frequencies can be achieved.

DE 100 84 870 T1 discloses an exhaust-gas system for a vehicle which has a muffler that is coupled via a branch line to a Helmholtz resonator which is formed from a stand-alone resonator housing. The housing is arranged on the vehicle underside and does not have exhaust gas flowing through it and is formed from a polymer.

It is also already known in the art for switchable exhaust-gas flaps to be provided in the exhaust-gas system, said flaps further reducing noise emissions when they are closed, due to a resulting reduction in the cross section of the exhaust-gas lines that can be flowed through by the exhaust gas. However, the aforementioned measures regularly increase the exhaust-gas counter-pressure prevailing in the exhaust-gas system and consequently cause a deterioration in the responsiveness of the internal combustion engine experienced by the vehicle driver and increase the engine's fuel consumption due to the expulsion work that has to be done by the internal combustion engine against the high exhaust-gas counter-pressure.

Taking this as the starting point, the problem addressed by the present invention is that of creating an exhaust-gas system for a vehicle with an internal combustion engine, which exhaust-gas system allows a reduction in noise emissions from the internal combustion engine without, however, thereby generating a high exhaust-gas counter-pressure. A method for operating an exhaust-gas system of an internal combustion engine is also to be provided.

In order to solve this problem, there is provided an exhaust-gas system, and a method of operating same, in accordance with embodiments of the invention.

The invention creates an exhaust-gas system for a vehicle having an internal combustion engine, with a Helmholtz resonator and two exhaust-gas lines extending towards the resonator, wherein the resonator has two neck openings to a resonator volume. Each neck opening is coupled to one of the exhaust-gas lines, and the resonator is tuned for the damping of a dominant engine order.

The invention takes account of the cramped spatial conditions routinely found in a vehicle for sound damping and, rather than using the muffler capacity for the integration of damping components which allow sound damping according to the reflection method or absorption method, provides for the configuration of a Helmholtz resonator in a housing utilizing the possible sound-damping volume. The resonator volume (also referred to herein as resonator capacity) is coupled by means of a neck opening in each case with one of the exhaust-gas lines of the dual-flow exhaust-gas system.

Consequently, the exhaust-gas system comprises two exhaust-gas lines which are provided for the exhaust-gas line from the internal combustion engine towards the exhaust-gas outlet openings and each exhaust-gas line is coupled by means of a neck opening or branch line to the housing forming the resonator volume of the Helmholtz resonator and the Helmholtz resonator is tuned for the damping of at least one engine order specific to the internal combustion engine. The engine order in this case may be the one that makes the greatest contribution in quantitative terms to the opening level; the resonator may therefore be tuned to the frequency that contributes the greatest sound-pressure level in quantitative terms to a measured opening level. The resonator may, for example, be accurately tuned to the frequency that produces the highest level in a licensing run for type approval.

This opening level may therefore be the relevant opening level in the case of a licensing run for worldwide type approval for the vehicle, for example, said opening level then being reduced by means of the resonator to a permitted measured sound-pressure level, without this requiring sound-damping devices which work according to the reflection or absorption method. Due to the absence of sound-damping devices which work according to the reflection or absorption method, the disadvantage associated therewith of increasing the exhaust-gas counter-pressure in the exhaust-gas plant is also eliminated.

A development of the invention is provided in this case, in that the resonator comprises a housing exhibiting the resonator volume, which housing is configured separately from other component housings of the exhaust-gas system. The housing is arranged spaced apart from the rear region of the vehicle. This configuration means that within the framework of the installation space available for sound-damping measures on the vehicle, the largest possible resonator volume is used and the resonator housing is attached at a great distance from the rear region of the vehicle, as a result of which a component exhibiting a rigid structure, namely the housing required for sound damping, is removed from the region of the rear structure of the vehicle and if the rear of the vehicle is damaged by the rigid component, components on the vehicle which are no longer adjacent are damaged by the rigid component.

According to a development of the invention, it is also provided that the exhaust-gas system has a flap in each case arranged in the region between the exhaust-gas line and the resonator volume, which flap is configured for the at least partial opening and/or closing of the neck opening in each case. With these flaps arranged adjacent to the resonator volume, the Helmholtz resonator can be switched on or switched off, as it were. It is therefore possible to influence the sound level at the exhaust-gas outlet openings of the exhaust-gas lines. It is also possible to adjust the damping level of the resonator variably through an only partial opening of the neck openings. In this case, the resonance frequency of the damping does not change, but only the degree of damping corresponding to the opening angle of the flaps or resonator flaps.

The opening and/or closing of the flaps may take place in a speed-range-selective, gear-ratio-selective or driving-mode-selective manner. The flaps may, for example, be opened in a given speed range of the vehicle, so that the Helmholtz resonator reduces the opening level, while the flaps are closed in another speed range of the vehicle or, for example, in a sports driving mode of the vehicle and the opening level is therefore higher.

According to a development of the invention, it is also provided that each exhaust-gas line in the through-flow direction of the exhaust-gas lines downstream of the resonator has at least two exhaust-gas outlet openings and at least one exhaust-gas outlet opening in each case is provided with an exhaust-gas flap, by means of which the exhaust-gas outlet opening is reversibly closable.

This means, in other words, that each exhaust-gas line has two exhaust-gas outlet openings, so in the case of two exhaust-gas lines, four exhaust-gas outlet openings are provided, wherein an exhaust-gas outlet opening of an exhaust-gas outlet opening pair in each case is provided with an exhaust-gas flap that can be controlled separately from the resonator flaps.

The respective exhaust-gas outlet opening can be closed by means of the exhaust-gas flap, as a result of which further influencing of the noise emissions from the vehicle is possible. The exhaust-gas flaps can be used in driving mode, for example, to prevent the noise emissions that compromise vehicle comfort, which noise emissions can occur when the vehicle is coasting, for example. The fact that the exhaust-gas flaps are actuated independently of the resonator flaps means that it is possible for the vehicle noise emissions to be influenced over a wide application range.

According to a development of the invention, it is also provided that the common cross section of the exhaust-gas outlet openings for each exhaust-gas line is of the same size as the cross section of the exhaust-gas line concerned. In other words, this means that the total cross section of the exhaust-gas outlet openings of an exhaust-gas line is equal in size to the cross section of this exhaust-gas line. In this way, it is achieved that the flow resistance occurring in the region of the exhaust-gas outlet openings and acting against the exhaust-gas flow is not greater than the flow resistance in the exhaust-gas line, as with known exhaust-gas systems.

This means that a reduction in exhaust-gas emissions can also be achieved, as the internal combustion engine does not have to perform greater expulsion work in order to remove the exhaust gases when there is a high exhaust-gas counter pressure. The reduction in the through-flow cross section required in the case of known exhaust-gas systems for the reduction in noise emissions can therefore be dispensed with in the case of the exhaust-gas system according to the invention.

According to a development of the invention, it is also provided that the exhaust-gas system exhibits a device for the joint actuation of the flap arranged between the resonator capacity and the respective exhaust-gas line. This device may be an integral part of the engine control system and jointly control both resonator flaps, as a result of which the cost involved in supplying signal lines or control lines to the resonator flaps in the vehicle is reduced.

According to a development of the invention, it is also provided that the exhaust-gas system exhibits a device for the joint actuation of the exhaust-gas flap arranged in a respective exhaust-gas outlet opening. This device may also be an integral part of the engine control system and jointly actuate the exhaust-gas flaps, as a result of which the number of signal lines or control lines to the exhaust-gas flaps on the vehicle is in turn reduced.

According to a development of the invention, it is also provided that the exhaust-gas system has a sound-damping device provided in the through-flow direction of the exhaust-gas lines downstream of the resonator. This device for sound damping may, for example, be a rear muffler receiving the outlet opening of the respective exhaust-gas line, with which rear muffler the vehicle-specific acoustic pattern can be influenced.

According to a development of the invention, it is also provided that the resonator volume is divided by means of a partition wall into at least two partial volumes. The partial volumes can also be coupled in a controlled manner by means of an aperture passing through the partition wall, for example by means of a flap closing or opening the aperture, as a result of which the possibility is created of a further engine order being dampened in addition to the dominant engine order.

According to a development of the invention, it is also provided that the resonator has a housing body made of a plastics material, as a result of which a reduction in the dead weight of the resonator can be achieved.

Finally, it is also provided according to a development of the invention that the exhaust-gas system has a further neck opening extending in each case from the respective exhaust-gas line to the resonator volume and at least one of the existing neck openings is provided with a flap for the at least partial opening and/or closing of the neck opening in each case. In this way, a configuration is created with which a second frequency can be damped in addition to a damping frequency. When a flap is closed, the resonator dampens a first frequency by means of the neck opening which is still present and permanently open and when the flap is open the resonator also dampens the second frequency. The two frequencies may be disruptive frequencies within the meaning of humming or droning or also a disruptive frequency of this kind and the other frequency may then be a frequency which is to be lowered in respect of its level for the licensing run or the like.

The neck opening which is constantly open in this configuration for each exhaust-gas line in the direction of the resonator volume produces a bypass line with which the first disruptive frequency is permanently damped, while the second disruptive frequency can either be dampened or not dampened by opening or closing the other neck opening.

Finally, a method for operating an exhaust-gas system of a vehicle's internal combustion engine is provided according to the invention, as has been described above, and the exhaust-gas system is provided with an exhaust-gas flap in an exhaust-gas outlet opening, wherein it is provided according to the method that the exhaust-gas flap is closed when the vehicle is coasting. In this way, special disruptive frequencies occurring when the vehicle is coasting can be eliminated.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
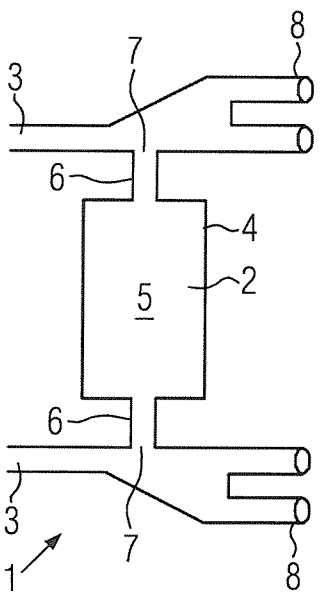
FIG. 1 shows a schematic representation of an embodiment of an exhaust-gas system with two exhaust-gas lines and four exhaust-gas outlet openings and a Helmholtz resonator.

FIG. 1 in the drawing shows a schematic representation of an embodiment of a two-stage exhaust-gas system 1 with a Helmholtz resonator 2.

The two-stage exhaust-gas system 1 has two exhaust-gas lines 3 with a resonator housing 4 arranged in the region between the two exhaust-gas lines 3. The two exhaust-gas lines 3 start from an internal combustion engine (not depicted in greater detail) of a vehicle (likewise not represented in greater detail). The resonator housing creates a resonator volume 5 of the Helmholtz resonator 2.

The resonator housing 4 has two branch lines 6 extending in the direction of the exhaust-gas lines 3, said branch lines forming neck openings 7 of the Helmholtz resonator 2.

The resonator housing 4 does not have exhaust gas flowing through it, which means that during operation of the exhaust-gas system 1 it is not exposed to hot exhaust gas with a heat flow passing through the resonator 2 and can therefore be made of a plastics material.

The Helmholtz resonator 2 is tuned via an arrangement of the resonator volume adapted to the respective internal combustion engine, the length of the resonator neck, in other words the length of the branch line 6, and the diameter of the resonator neck. This tuning means that the resonator 2 is designed for the frequency which has the highest sound-pressure level in quantitative terms of an opening level measured during a test run or a licensing run of the vehicle, for example.

This may, for example, involve a test run being carried out using a vehicle without a Helmholtz resonator and the opening level measured in a test section being tested for the frequency which generates the highest sound-pressure level during the test run. A corresponding tuning of the Helmholtz resonator to this frequency means that this frequency can then be correspondingly reduced during a test run with the Helmholtz resonator, without sound-damping devices which work according to the reflection, absorption or resonance method being necessary.

Figure 12:
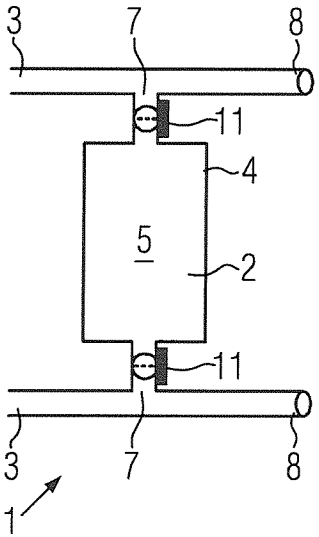
FIG. 12 shows a representation of an arrangement similar to that according to FIG. 5, in turn with only one exhaust-gas outlet opening for each exhaust-gas line side.
Figure 11:
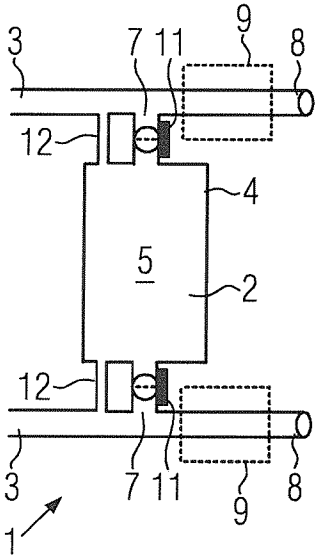
FIG. 11 shows a representation of an arrangement similar to that according to FIG. 9, but without an exhaust-gas flap in the region of the exhaust-gas outlet opening.
Figure 10:
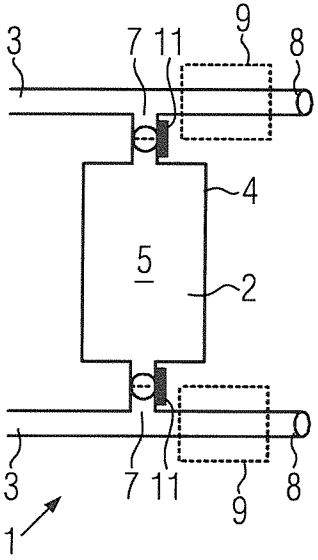
FIG. 10 shows a representation of an arrangement similar to that according to FIG. 6 which differs in that only one exhaust-gas outlet opening is provided for each exhaust gas line side.

In the case of the embodiment shown in FIG. 1, the exhaust-gas system 1 has two exhaust-gas outlet openings 8 for each exhaust-gas line 3 or exhaust-gas line side, wherein the exhaust-gas system 1 according to the invention is not limited to this number of exhaust-gas outlet openings, but may also have only one exhaust-gas outlet opening 8 for each exhaust-gas line 3, as is the case, for example, with the embodiments of the exhaust gas line according to FIG. 10 through FIG. 12.

Figure 2:
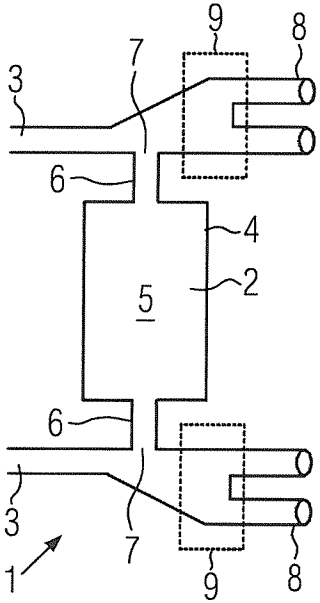
FIG. 2 shows a representation similar to that according to FIG. 1 with an additional rear muffler for each exhaust-gas line of the exhaust-gas system.

FIG. 2 shows a modified embodiment of the exhaust-gas system 1 with a rear muffler 9 for each exhaust-gas line side. With the rear muffler 9, the acoustic pattern that can be acoustically perceived by the vehicle user can be influenced, for example in the direction of a sporting acoustic pattern or one enriched with low frequencies.

Figure 3:
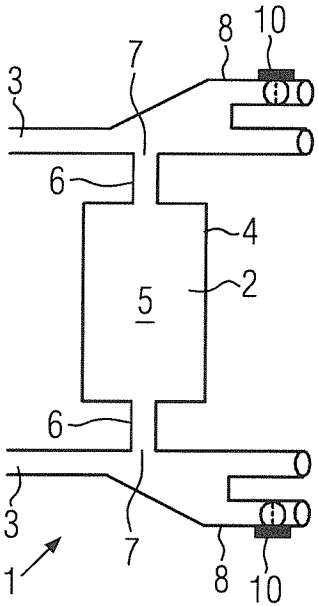
FIG. 3 shows a representation similar to that in FIG. 1 with a switchable exhaust-gas flap in an exhaust-gas outlet opening for each exhaust-gas line.

FIG. 3 shows an embodiment of an exhaust-gas system 1, in which two exhaust-gas outlet openings 8 are each provided with a reversibly closable exhaust-gas flap 10. The exhaust-gas flap 10 may be actuated via a device (not shown in greater detail) for the opening and closing of the exhaust-gas outlet opening 8. The device may, for example, be implemented by the engine control system of the internal combustion engine, which delivers a control signal for closing the exhaust-gas flap 10 to an actuating device of the exhaust-gas flap 10 if the vehicle, and therefore the internal combustion engine, starts coasting. The exhaust-gas flap 10, which is then closed, prevents the emission of frequencies that can be perceived as droning.

Figure 4:
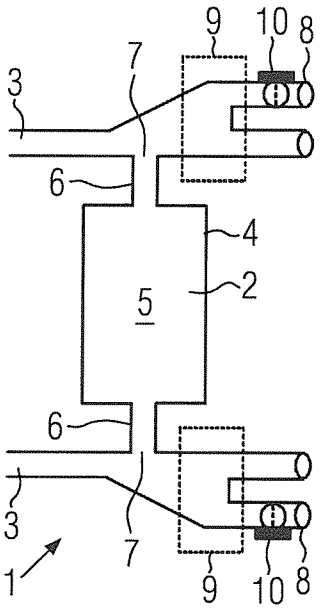
FIG. 4 shows a representation similar to that according to FIG. 3 with an additional rear muffler for each exhaust-gas line of the exhaust-gas system.

FIG. 4 shows a further modified embodiment of the exhaust-gas system 1 with two exhaust-gas flaps 10, one of which is provided on an exhaust-gas outlet opening 8, and a rear muffler 9 provided for each exhaust-gas line side. The acoustic pattern of the internal combustion engine can be influenced by the rear muffler 9, as has already been mentioned above.

Figures 5, 6, 7, 8, 9:
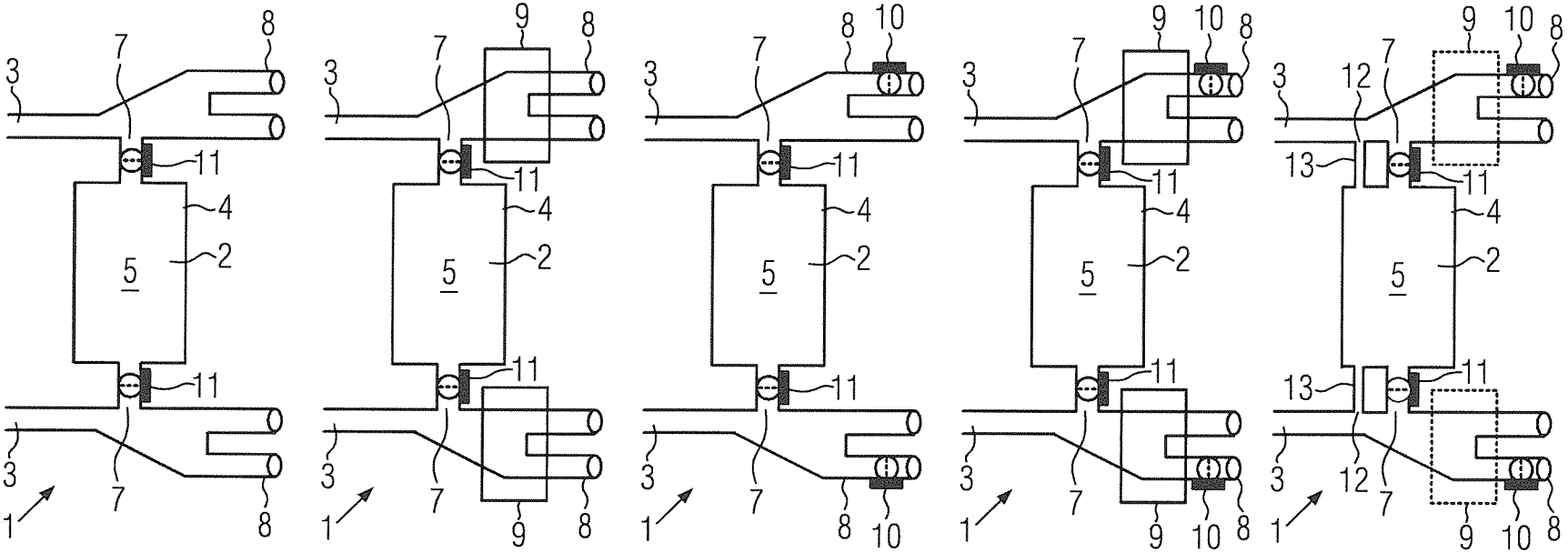
FIG. 5 shows a representation similar to that according to FIG. 1 with a resonator flap for each neck opening.
FIG. 6 shows a representation similar to that according to FIG. 5 with an additional rear muffler for each exhaust-gas line of the exhaust-gas system.
FIG. 7 shows a representation similar to that according to FIG. 6 with an additional exhaust gas flap in an exhaust-gas outlet opening for each exhaust-gas line of the exhaust-gas system.
FIG. 8 shows a representation similar to that according to FIG. 7 with an additional rear muffler for each exhaust-gas line of the exhaust-gas system.
FIG. 9 shows a representation of an arrangement similar to that according to FIG. 8 with a further neck opening in the direction of the resonator capacity starting from the exhaust-gas line, in addition to the neck opening for each exhaust-gas line that can be switched using a resonator flap.

FIG. 5 shows an embodiment of the exhaust-gas line 1 with two exhaust-gas lines 3 and a Helmholtz resonator 2 inserted between the exhaust-gas lines 3, as has already been explained with reference to FIG. 1 in the drawing.

Unlike in the embodiment according to FIG. 1, the Helmholtz resonator 2 according to FIG. 5 can be switched, so with regard to its damping function into a damping and non-damping state. To this end, the neck openings 7 can be varied using a flap or resonator flap 11 arranged in the region of a neck opening 7 in each case, in such a manner that the neck openings 7 can be blocked or in other words closed or opened.

In the case of neck openings 7 blocked by activating the resonator flaps 11, the damping action of the resonator 2 is eliminated and, in the case of neck openings 7 which are made open or passable by actuating the resonator flaps 11, the resonator 2 performs the damping function described above.

In all embodiments of the exhaust-gas system 1 with resonator flaps 11, it is also provided according to the present invention that the resonator flaps 11 can not only be opened or closed digitally, so to speak, but can also adopt angled positions between the opening state and the closing state, as a result of which the degree of damping of the resonator 2 can be variably set. By changing the degree of opening of the resonator flaps 11, the resonance frequency of the damping does not change, but only the degree of damping corresponding to the opening angle of the resonator flaps 11 that has been set.

FIG. 6 shows an embodiment of an exhaust-gas system 1 with controllable or variable resonator flaps 11, as have just been described, and a rear muffler 9 for each exhaust gas line side, with which the acoustic pattern of the exhaust-gas system can be configured.

FIG. 7 shows an embodiment of an exhaust-gas system 1 with controllable or variable resonator flaps 11 and additional exhaust-gas flaps 10 in the region of two exhaust-gas outlet openings 8. As has already been explained above, apart from influencing the acoustic pattern of the internal combustion engine by switching the resonator 2 on or off, the damping can also be changed while the vehicle is coasting, in that the exhaust gas flaps 10 are actuated by the engine control system, for example, in order to close the corresponding exhaust-gas outlet opening 8.

A further reduction in the noise level emitted by the exhaust-gas system 1 can be achieved in that the exhaust-gas transmission diameter of the exhaust-gas outlet opening 8 without the exhaust-gas flap 10 is substantially reduced compared with the diameter of the exhaust-gas line 3, so that through this configuration the acoustic pattern of the internal combustion engine can be changed in a broad setting range.

FIG. 8 shows an embodiment of an exhaust-gas system 1 similar to that according to FIG. 7 with a rear muffler 9 provided in addition for each exhaust-gas line side, arranged downstream of the resonator 2, for influencing the acoustic pattern of the engine.

FIG. 9 shows a further modified embodiment of an exhaust-gas system 1 in which, apart from two first neck openings 7 controllable or variable by means of two resonator flaps 11, two further neck openings 12 are provided, namely a neck opening 12 for each exhaust-gas line 3, which neck opening is formed by a branch line 13 arranged between the respective exhaust-gas line 3 and the resonator housing 4.

This embodiment creates a switchable or variable resonator 2 which also performs the function of a basic resonator. The term "basic resonator" in this case should be understood to mean a resonator tuned to a first frequency, the basic frequency, the resonator being configured for the damping thereof. The basic frequency in this case is determined by, among other things, the opening diameter of the neck opening 12, so that the resonator depicted in FIG. 9 of the drawing always dampens the basic frequency, as the branch lines 13 are constantly open.

The basic frequency may, for example, be a frequency which determines in a dominant manner a sound level to be observed during a test run or licensing run and which is therefore permanently damped. If the exhaust-gas flaps 11 are open, the resonator can also still dampen a second disruptive frequency. The branch lines 13 and the resonator flaps 11 can be tuned in relation to their length and the common cross section to a required damping frequency, which may also be, for example, the damping frequency required for the licensing run or a second frequency found to be disruptive in a given driving mode.

FIG. 10 to FIG. 12 show embodiments of exhaust-gas systems with two exhaust-gas lines 3 and a resonator 2 in each case, each having only one outlet pipe or an exhaust gas outlet opening 8.

The resonator 2 depicted in FIG. 10 has two controllable or variable resonator flaps 11, the function of which corresponds to the resonator flaps 11 explained in connection with FIG. 5 in the drawing.

FIG. 11 shows an embodiment of an exhaust-gas system 1 similar to that according to FIG. 9 with additional neck openings 12, which are always open, and resonator flaps 11. While the exhaust-gas system depicted in FIG. 9 also still has two exhaust-gas flaps 10 on two exhaust-gas outlet openings 8 which are provided to dampen droning frequencies when the vehicle is coasting, for example, the exhaust-gas system shown in FIG. 11, as well as the exhaust-gas system according to FIG. 9, has two rear mufflers 9, but not the exhaust-gas flaps 10.

The exhaust-gas system depicted in FIG. 11 is provided for arrangement on an internal combustion engine, for example, which does not generate any disruptive droning frequencies while coasting, so that the exhaust-gas flaps 11 can be omitted to make cost reductions.

Finally, FIG. 12 shows an exhaust gas system with two exhaust-gas lines 3 and a resonator 2 that can be controlled and varied via the resonator flaps 11, so that in this embodiment too the damping degree of the resonator 2 can be varied in accordance with the opening angle of the resonator flaps 11. In order to reduce costs compared with the exhaust-gas system depicted in FIG. 10, the exhaust-gas system depicted in FIG. 12 does not have a rear muffler 9 for each exhaust-gas line side, however, as is depicted in the embodiment according to FIG. 10.

Although in the embodiments of the exhaust-gas system shown in the figures, apart from the Helmholtz resonator in each case, no further sound-damping housings are depicted. However, in the exhaust-gas system in each case a further sound-damping device in the form of a mid-muffler can be arranged in the region upstream of the Helmholtz resonator.

In the respective embodiment with exhaust-gas flaps in the exhaust-gas outlet opening, the exhaust-gas flap takes over the damping of disruptive frequencies, particularly when the engine is coasting. In an embodiment with additional resonator flaps the noise level at the exhaust-gas outlet openings can be changed over wide ranges and the acoustics of the exhaust-gas system can thereby be particularly influenced, as a resonator which is at least partially open due to the opening of the resonator flaps takes over the function of a cross-talk point, so that particularly with an internal combustion engine in V-configuration, a clearly different acoustic pattern results than with an exhaust-gas system without a cross-talk point.

A resonator provided with additional, always open neck openings can also be used for damping a disruptive frequency occurring when the resonator flaps are closed.

Since the resonator does not have hot exhaust gas flowing through it, it can be produced from a plastics material, for example, as a result of which a substantial reduction in the dead weight of the resonator results. Through the use of plastic or also of a carbon-fiber-reinforced plastic, for example, the resonator housing can be adapted to the geometry of the underside of the vehicle and therefore also be moved from the rear region of the vehicle toward the center of the vehicle, as a result of which the crash behavior of the vehicle is improved.

LIST OF REFERENCE NUMBERS

1. Exhaust-gas system
2. Helmholtz resonator
3. Exhaust-gas lines
4. Resonator housing
5. Resonator volume
6. Branch lines
7. Neck opening
8. Exhaust-gas outlet opening
9. Rear muffler
10. Exhaust-gas flap
11. Flap, resonator flap
12. Neck opening
13. Branch line The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust-gas system for a vehicle having an internal combustion engine, comprising:

a Helmholtz resonator within a resonator housing defining a resonator volume, the resonator being tuned for damping a dominant engine order; and two exhaust-gas lines extending laterally past the resonator housing, wherein the resonator housing has two neck openings to the resonator volume, each neck opening being coupled to a respective one of the two exhaust-gas lines such that exhaust does not flow through the resonator volume.

2. The exhaust-gas system as claimed in claim 1, wherein the resonator housing is configured separately from other component housings of the exhaust-gas system, and the housing is arranged spaced apart from a rear region of the vehicle.

3. The exhaust-gas system as claimed in claim 1, further comprising:

a flap in each case arranged in a region between the exhaust-gas line and the resonator volume, which flap is configured for the at least partial opening and/or closing of the neck opening in each case.

4. The exhaust-gas system as claimed in claim 3, wherein each exhaust-gas line in a through-flow direction of the exhaust-gas lines downstream of the resonator has at least two exhaust-gas outlet openings, and at least one exhaust-gas outlet opening in each case is provided with an exhaust-gas flap, by which the exhaust-gas outlet opening is reversibly closable.

5. The exhaust-gas system as claimed in claim 4, wherein a common cross section of the exhaust-gas outlet openings for each exhaust-gas line is of a same size as the cross section of the exhaust-gas line.

6. The exhaust-gas system as claimed in claim 3, further comprising:

an actuator for joint actuation of the flap arranged between the resonator volume and the respective exhaust-gas line.

7. The exhaust-gas system as claimed in claim 4, further comprising:

an actuator for joint actuation of the exhaust-gas flap arranged in a respective outlet opening.

8. The exhaust-gas system as claimed in claim 1, further comprising:

a sound-damping device provided in a through-flow direction of the exhaust-gas lines downstream of the resonator.

9. The exhaust-gas system as claimed in claim 1, wherein the resonator volume is divided by a partition wall into at least two partial volumes.

10. The exhaust-gas system as claimed in claim 9, wherein the partition wall has an aperture connecting the partial volumes.

11. The exhaust-gas system as claimed in claim 1, wherein the resonator has a housing body made of a plastics material.

12. The exhaust-gas system as claimed in claim 1, further comprising:

a further neck opening extending, in each case, from a respective exhaust-gas line to the resonator volume, wherein at least one of the neck openings for each exhaust-gas line is provided with a flap for the at least partial opening and/or closing of the neck opening in each case.

13. A method of operating an exhaust-gas system for a vehicle having an internal combustion engine, wherein the exhaust-gas system comprises: a Helmholtz resonator within a resonator housing defining a resonator volume, the resonator being tuned for damping a dominant engine order; and two exhaust-gas lines that extend laterally past the resonator housing, wherein the resonator housing has two neck openings into the resonator volume, each neck opening being coupled to a respective one of the two exhaust-gas lines such that exhaust does not flow through the resonator volume, wherein the method comprises the acts of:

providing the exhaust-gas system with an exhaust-gas flap in an exhaust-gas outlet opening; and closing the exhaust-gas flap when the vehicle is coasting.

* * * * *